US008813672B2

(12) United States Patent
Nelson

(10) Patent No.: US 8,813,672 B2
(45) Date of Patent: Aug. 26, 2014

(54) SWIMMING PLATFORM FOR A BOAT

(76) Inventor: Gary Nelson, Minneola, FL (US)

( * ) Notice: Subject to any disclaimer, the term of this patent is extended or adjusted under 35 U.S.C. 154(b) by 179 days.

(21) Appl. No.: 13/429,106

(22) Filed: Mar. 23, 2012

(65) Prior Publication Data

US 2012/0240839 A1 Sep. 27, 2012

Related U.S. Application Data

(60) Provisional application No. 61/467,301, filed on Mar. 24, 2011.

(51) Int. Cl.
*B63B 17/00* (2006.01)

(52) U.S. Cl.
USPC ..... 114/362

(58) Field of Classification Search
USPC ..... 114/362, 274
See application file for complete search history.

(56) References Cited

U.S. PATENT DOCUMENTS

| | | | | |
|---|---|---|---|---|
| 3,606,934 | A * | 9/1971 | Johansen | 182/97 |
| 4,146,941 | A * | 4/1979 | Haslam | 114/362 |
| 5,203,275 | A * | 4/1993 | Brauner et al. | 114/274 |
| 2001/0010200 | A1 * | 8/2001 | Woolley | 114/274 |

* cited by examiner

*Primary Examiner* — Stephen Avila
(74) *Attorney, Agent, or Firm* — McKinney Law, PLLC

(57) ABSTRACT

A swimming platform assembly that is adapted to be mounted to a drive assembly housing of a watercraft includes a support platform adapted to provide a stable support for a swimmer and a mounting assembly coupled to the support platform to mount the support platform onto the watercraft. The support platform has planar top and bottom surfaces, while the mounting assembly is secured to an intermediate portion of a drive assembly housing of the watercraft such that the top surface of the support platform is disposed below the surface of the water when the watercraft is stationary or is traveling in a forward direction at or below a critical rate of speed, and such that the bottom surface of the support platform is disposed above the surface of the water when the watercraft is traveling in a forward direction above the critical rate of speed.

7 Claims, 4 Drawing Sheets

SWIMMING PLATFORM FOR A BOAT

RELATED APPLICATIONS

This application is a regularly filed application of and claims the benefit of priority to U.S. Provisional Patent Application Ser. No. 61/467,301, entitled "Swimming Platform for a Boat," which was filed on Mar. 24, 2011, the entire disclosure of which is hereby expressly incorporated by reference herein.

FIELD OF THE DISCLOSURE

This patent relates generally to watercraft, and, more particularly, to accessories for a watercraft.

BACKGROUND

Recreational boating is a popular leisure activity, and, in many cases, the passengers on a recreational boat exit the boat to swim, snorkel, or water ski. Because boats typically have a hull that extends several feet above the surface of the water, a swimming support platform is sometimes used to assist the swimmer in re-boarding the boat from the water. One type of typical swimming support platform is a molded platform formed on or near the transom (i.e., the surface that forms the stern of the boat). Because the molded swimming support platform is disposed above the waterline, a ladder is required to allow a swimmer to climb onto the swimming support platform when exiting the water. Other commonly-used swimming support platforms are pivotably coupled to a portion of the transom on either side of an outboard motor or the drive unit of an inboard/outboard drive or are coupled to the side of the boat. Typically, these swimming support platforms may be rotated from a vertical storage position to a horizontal deployed position. When in the deployed position, the swimming support platform may be disposed approximately one foot below the waterline to allow swimmers to use their buoyancy to assist in mounting the swimming support platform when the swimmer desires to re-board the boat. Once on the swimming support platform, the swimmer can stand up and step over the transom or the side of the boat to safely board the boat.

However, when such a swimming support platform is no longer in use, the swimming support platform must be pivoted up and locked into the storage position. In a common scenario, the boater forgets to rotate the swimming support platform into the storage position prior to moving the boat, and the swimming support platform remains in the deployed position when the boat begins to move. Because the swimming support platform remains below the surface of the water when the boat is moving, large hydrodynamic forces act on the swimming support platform as the boat moves, especially at a high rate of speed, and these hydrodynamic forces may damage the swimming support platform, the hinging mechanism coupling the swimming support platform to the transom, or the transom itself. Even if the hydrodynamic forces do not cause physical damage, the hydrodynamic forces may result in drag forces that significantly reduce the fuel efficiency of the boat. Moreover, mounting the pivotable swimming support platform to the transom involves drilling holes into the transom, and these holes can cause leaks or rotting of the material forming the transom.

BRIEF SUMMARY

A swimming platform assembly adapted to be mounted to a drive assembly housing of a watercraft includes a support platform having a planar top surface and a bottom surface, with the support platform being adapted to provide a stable support for a swimmer. The platform assembly also includes a mounting assembly coupled to the support platform, the mounting assembly being adapted to be secured to an intermediate portion of the drive assembly housing such that the top surface of the support platform is disposed below the surface of the water when the watercraft is stationary or is traveling in a forward direction at or below a critical rate of speed, and such that the bottom surface of the support platform is disposed above the surface of the water when the watercraft is traveling in a forward direction above the critical rate of speed. This configuration allows the swimming platform to be mounted to the watercraft in a constant position at all times, without needing to be rotated from a horizontal position when the watercraft is moving, while at the same time enabling the swimming platform to be used to enter and exit the watercraft when the watercraft is stationary in the water.

DETAILED DESCRIPTION

Figure 1A:
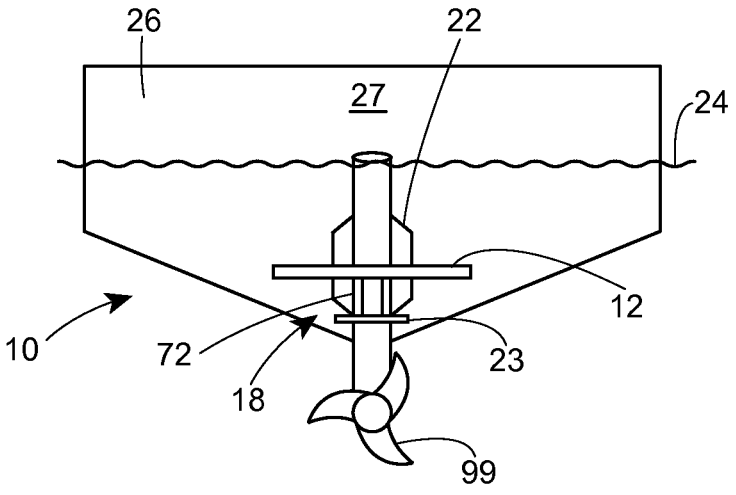
FIG. 1A is a rear view of an embodiment of a swimming platform assembly disposed on a boat which is at rest, with the waterline disposed above a top surface of a support platform of the swimming platform assembly.
Figure 1B:
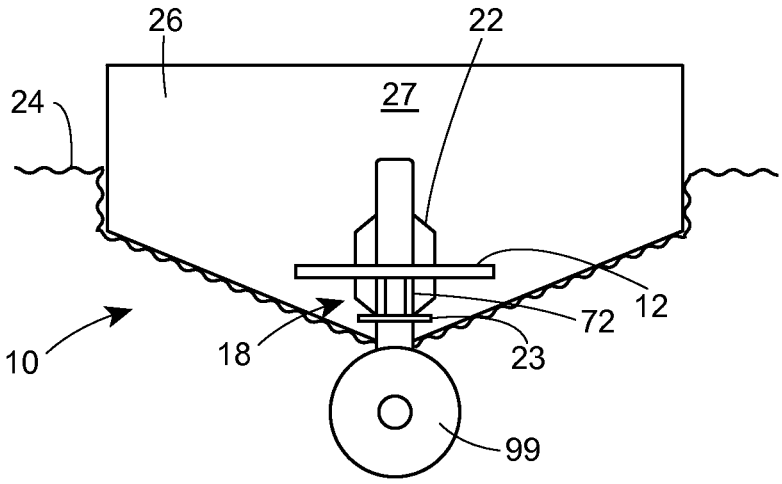
FIG. 1B is a rear view of an embodiment of a swimming platform assembly disposed on a boat as the boat is in motion through the water above a critical rate of speed, wherein the waterline is disposed below a bottom surface of the support platform of the swimming platform assembly by natural operation of the boat.
Figure 2A:
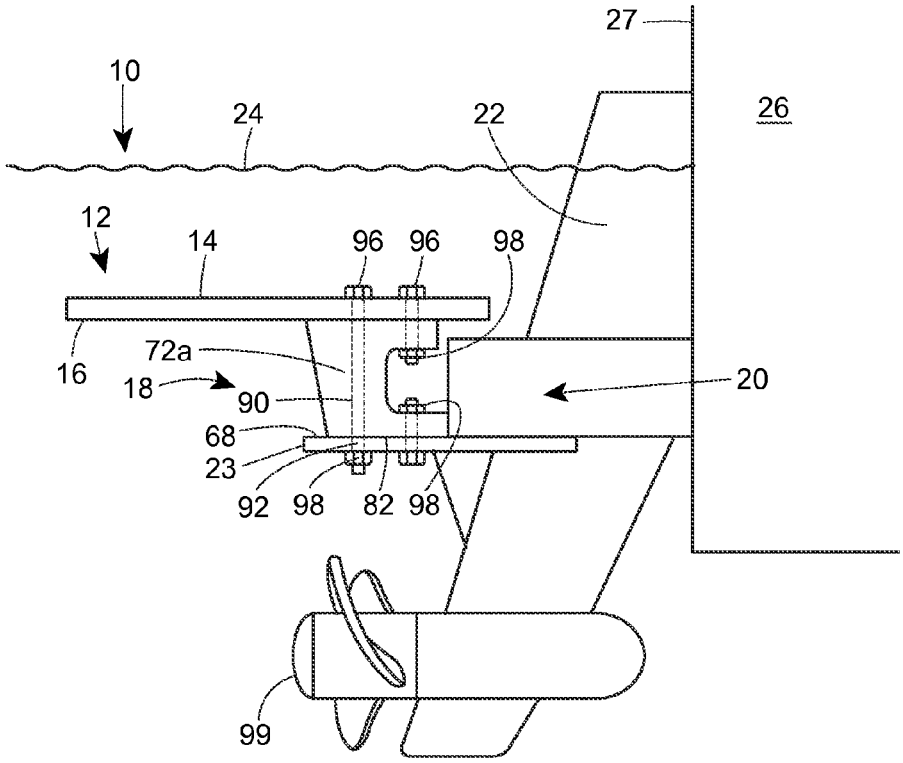
FIG. 2A is a side view of an embodiment of the swimming platform assembly of FIGS. 1A and 1B disposed on a boat at rest, with the waterline disposed above the top surface of the support platform.
Figure 2B:
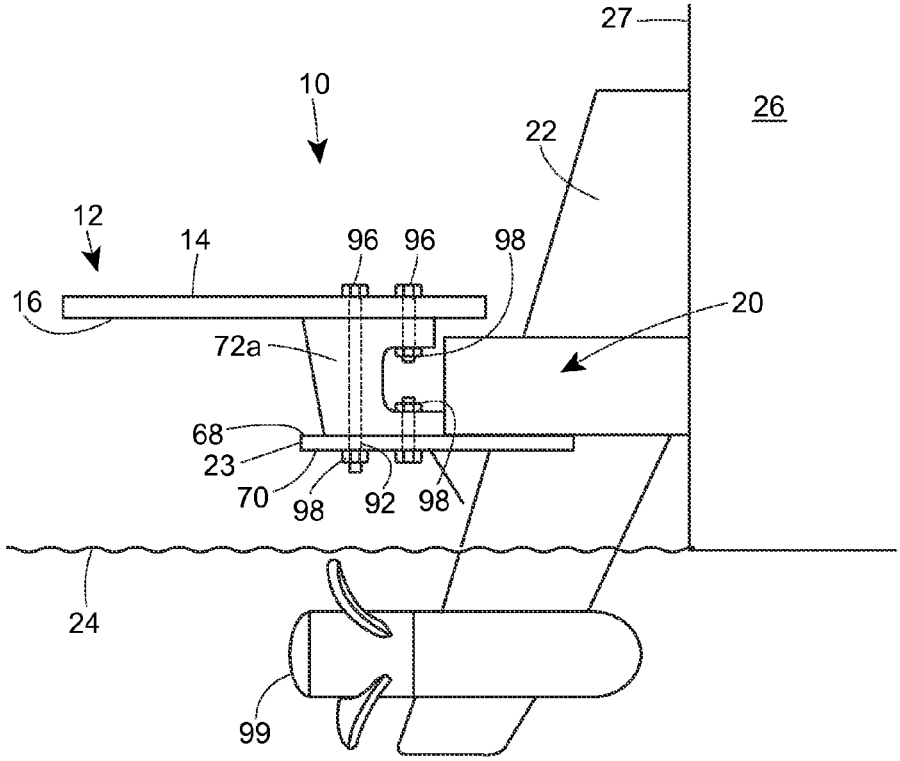
FIG. 2B is a side view of an embodiment of the swimming platform assembly of FIGS. 1A and 1B disposed on a boat that is in motion through the water above a critical rate of speed, wherein the waterline is disposed below the bottom surface of the support platform by natural operation of the boat.

As illustrated in FIGS. 1A, 1B, 2A, and 2B, a swimming platform assembly 10 that may be used to support a swimmer when the assembly 10 is mounted on a watercraft, such as a boat or other vessel, includes a support platform 12 having a planar top surface 14 and a planar bottom surface 16 (marked in FIGS. 2A and 2B). The swimming platform assembly 10 also includes a mounting assembly 18 coupled to the support platform 12, wherein the mounting assembly 18 is adapted to be coupled to an intermediate portion 20 of a drive assembly housing 22 of a watercraft or vessel 26. For example, the mounting assembly 18 may be coupled to an anti-cavitation plate 23 that may extend from an intermediate portion 20 of the drive assembly housing 22. With the platform assembly 10 secured to the intermediate portion 20 of the drive assembly housing 22, the top surface 14 of the support platform 12 is disposed below the waterline 24 when the vessel 26 is stationary in the water or is traveling in a forward direction at or below a critical rate of speed, as illustrated in FIGS. 1A and 2A. For example, when the engine is not engaged and the vessel 26 is drifting or is at anchor, as illustrated in FIG. 1A, the top surface 14 of the support platform 12 is below the waterline 24 (i.e., disposed below the surface of the water 24). Similarly, when the engine of the vessel 26 is engaged and the vessel 26 is traveling in a forward direction at a relatively low rate of speed (such as, for example only, 5 knots), the top surface 14 of the support platform 12 is disposed below the waterline 24.

However, when the vessel 26 travels in a forward direction at a rate of speed that is above a critical rate of speed (such as, for example only, a rate of speed of 17 miles per hour (mph)), the hull of the vessel 26 rises relative to the waterline 24 due to phenomenon known as "planing." Generally speaking, the critical rate of speed is the speed at which the hull of the vessel transitions from a displacement mode (in which the hull of the vessel operates as a displacement hull) to a planing mode (in which the hull of the vessel operates as a planing hull). In particular, when the hull of the vessel 26 operates in the planing mode, at least a portion of the hull of the vessel 26 rises up out of the water and begins to plane on the surface of the water, sometimes causing the back of the hull to rise up in the water by as much as a couple of feet, thereby raising the support platform 12 up out of the water. In addition, when in the planing mode, low pressure areas are created as water flows around the port and starboard sides of the hull of the vessel 26, and these low pressure areas result in the water immediately downstream of a transom 27 of the vessel 26 creating a depression in the waterline 24 (i.e., a depression in the surface of the water) immediately behind or downstream of the transom 27. If the shape of the transom 27 is symmetrical or substantially symmetrical about a longitudinal axis of the vessel 26, the depression will have a shape that is symmetrical about the longitudinal axis of the vessel 26. Because the swimming platform assembly 10 is coupled to a drive assembly housing 22 that passes through the longitudinal axis of the vessel 26, the bottom surface 16 of the support platform 12 is disposed above the surface of the water 24 when a depression of sufficient depth is created, as illustrated in FIGS. 1B and 2B. The planing of the vessel 26 also elevates the support platform 12 relative to the waterline 24, which further contributes to maintaining the bottom surface 16 of the support platform 12 above the surface of the water 24 when the vessel 26 is moving forward above the critical rate of speed. Generally speaking, the critical rate of speed of a vessel will be determined by the hull characteristics of the vessel. However, most vessels having planing hulls generally begin to plane at a critical rate of speed between 12 mph and 20 mph, while a large number of vessels begin to plane at a critical rate of speed between 16 mph and 18 mph.

Accordingly, when the rate of speed of the vessel 26 is above a critical rate of speed, the bottom surface 16 of the support platform 12 is disposed within the depression created in the surface of the water 24. Consequently, at this time, the bottom surface 16 of the support platform 12 is disposed above the waterline 24, and the support platform 12 does not create a hydrodynamic drag force that slows the vessel 26, reduces the fuel efficiency of the vessel 26, and/or damages the swimming platform assembly 10 or the transom 27. Moreover, there is no need to fold up, remove, or otherwise stow the support platform 12 when the vessel 26 is underway. Advantageously, the support platform 12 and mounting assembly 18 may be secured to the drive assembly housing 22 and not directly to the transom 27. As a result, it is not necessary to drill holes in the transom 27, that may potentially result in leaks or rotting of the vessel 26, to mount the swimming platform assembly 10 to the vessel 26. Also, because the support platform 12 is disposed below the waterline 24 when the vessel 26 is at rest, a swimmer can use his or her natural buoyancy to assist in mounting the support platform 12 when the swimmer desires to re-board the vessel 26, thereby eliminating the need for a ladder or other climbing aid to assist in mounting the support platform 12.

Figure 3:
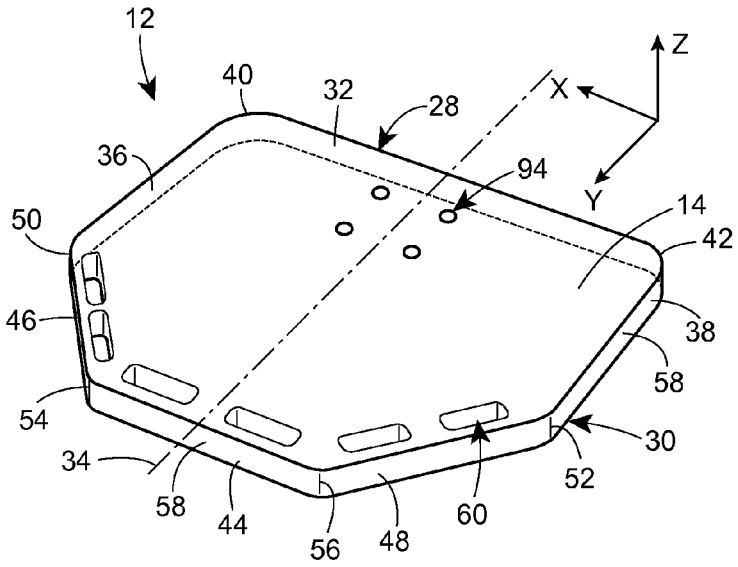
FIG. 3 is a perspective view of a support platform of an embodiment of the swimming platform assembly of FIGS. 1A, 1B, 2A, and 2B.
Figure 4:
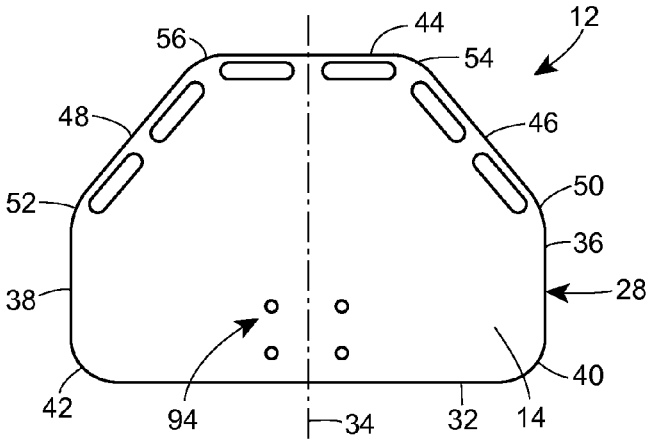
FIG. 4 is a top view of the support platform of FIG. 3.
Figure 5:
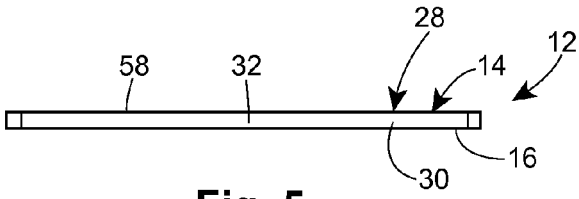
FIG. 5 is a side view of the support platform of FIG. 3.

As illustrated in FIGS. 3, 4, and 5, which depict the support platform 12 in greater detail, the top surface 14 of the platform 12 may be planar or substantially planar, and this top surface 14 may generally be bounded by a top peripheral edge 28. The bottom surface 16, which may also be planar, may be vertically offset (that is, offset in a direction along or parallel to the Z axis of the reference coordinate system provided in FIG. 3) from the top surface 14 such that the bottom surface 16 is parallel to the top surface 14. Instead of being planar, the bottom surface 16 may be substantially planar and may have contours, ridges and/or other surface features that extend across the bottom surface 16 (or portions of the bottom surface 16). The bottom surface 16 may be bounded by a bottom peripheral edge 30, and the bottom peripheral edge 30 may have the same shape or substantially the same shape as the top peripheral edge 28. A side wall 58 formed between the top peripheral edge 28 and the bottom peripheral edge 30 may include a plurality of wall segments 32, 36, 38, 44, 46, and 48 and corners 40, 42, 50, 52, 54, and 56. Any or all of the walls 58 may be rounded or otherwise contoured to eliminate sharp corners at the junction between a wall segment and the top surface 14 and/or the bottom surface 16.

More particularly, the segments of the side wall 58 may include an inward wall segment 32 (being closest to the vessel 26) that may extend perpendicularly relative to a central axis 34 that passes through the plane of the top surface 14 and that is aligned or is parallel to the longitudinal axis of the vessel 26. A first lateral wall segment 36 and a second lateral wall segment 38, each of which may be parallel to and equidistant from the central axis 34, are disposed on either side of the inward wall segment 32 and the distance between the first lateral wall segment 36 and the second lateral wall segment 38 may be approximately 30 inches. However, the first lateral wall segment 36 and the second lateral wall segment 38 may be separated by any appropriate distance which will, in many cases, be determined by the dimensions and configuration of the vessel 26 to which the support platform 12 is attached. Additionally, an outward wall segment 44 may extend parallel to and may be offset from the inward wall segment 32 such that the outward wall segment 44 is bisected by the central axis 34. The distance between the inward wall segment 32 and the outward wall segment 44 may be approximately 22 inches. However, the inward wall segment 32 and the outward wall segment 44 may be separated by any appropriate distance. Again, the appropriate distances will be determined by the dimensions and configuration of the vessel 26 to which the platform 12 is attached. A first oblique wall segment 46 and a second oblique wall segment 48 each generally extends from the first or second lateral wall segments 36, 38, respectively, to the outward wall segment 44. Each of the first and second oblique wall segments 46, 48 may converge towards the central axis 34 as the first and second oblique wall segments 46, 48 extend towards the outward edge segment 44.

As indicated in FIG. 3, a first rounded corner 40 and a second rounded corner 42 extend between the inward wall segment 32 and the first lateral wall segment 36 and the second lateral wall segment 38, respectively. Likewise, a third rounded corner 50 extends between the first lateral wall segment 36 and the first oblique wall segment 46 while a fourth rounder corner 52 extends between the second lateral wall segment 38 and the second oblique wall segment 48. A fifth rounded corner 54 extends between the outward wall segment 44 and the first oblique wall segment 46 while a sixth rounded corner 52 extends between the outward wall segment 44 and the second oblique wall segment 48. As illustrated in FIGS. 3 and 4, the plurality of wall segments and corners 32-56 may each have a center line that is confined to a horizontal plane (i.e., a plane parallel to the X-Y plane indicated in the reference coordinate system provided in FIG. 3).

In alternate embodiments, the support platform 12 may be formed with side walls 58 forming a top surface 14 having any suitable shape or combination of shapes. For example, the side walls 58 may include the straight inward edge segment 32 with curved wall segments extending outward from the inward edge segment 32 such that the curved wall segments form the general shape of a semi-circle, thereby giving the top surface 14 a general semi-circular shape. The curved wall segments may also have the shape of a portion of an oval or other shape. The side wall 58 may also include a combination of curved wall segments that may, for example, form a pattern or a series or irregular shapes. Instead of a generally semi-circular shape, for example, the top surface 14 may have the shape of a polygon, such as a triangle, a rectangle, a square, a trapezoid, or a pentagon or any other desired configuration.

The top surface 14 may have a surface treatment to increase the frictional engagement between a swimmer's foot or hand and the support platform 12. The surface treatment may be, for example, a surface coating and/or a plurality of depressions, nubs, grooves, or contours. All or portions of the top surface 14 may be treated if desired or different portions of the top surface 14 may be treated differently to form areas of varying frictional engagement.

Figure 6:
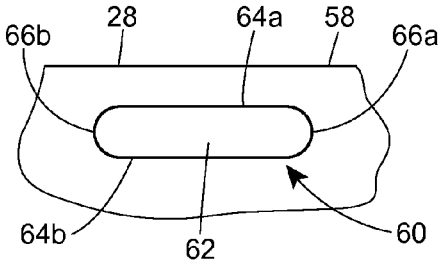
FIG. 6 is a detail view of an embodiment of an aperture disposed through the support platform of FIG. 3.

As illustrated in FIGS. 3, 4, and 6, the support platform 12 may also include one or more apertures 60 that vertically extend between the top surface 14 and bottom surface 16 of the support platform 12. Each of the apertures 60 may be formed as an elongated slot 62 partially defined by parallel side walls 64*a*, 64*b* that each extends lengthwise in the direction or the general direction of an adjacent segment of the top peripheral edge 28. Each slot 62 may be further defined by a pair of curved end walls 66*a*, 66*b* that each extends between the side walls 64*a*, 64*b*. Each elongated slot 62 may be dimensioned and positioned such that a portion of the support platform 12 between the side wall 64*a* of the elongated slot 62 and the side wall 58 of the support platform 12 may be grasped by a swimmer. In one embodiment of the support platform 12, two elongated slots 62 may be positioned such that the longitudinal axes of the elongated slots 62 are aligned and are parallel to and offset from each of the first oblique wall segment 46, the second oblique wall segment 48, and the outward wall segment 44. Instead of a slot 62, the one or more of the apertures 60 may have any suitable shape to allow a portion of the support platform 12 between a side wall 64 of the aperture 60 and a side wall 58 of the support platform 12 to be grasped by a swimmer.

As best illustrated in FIGS. 2A and 2B, the mounting assembly 18 of the platform assembly 10 may be secured to an anti-cavitation plate 23 that extends from the intermediate portion 20 of the drive assembly housing 22 of the vessel 26. Typically, the anti-cavitation plate 23 is an existing component that has been pre-installed on the drive assembly housing 22, and the anti-cavitation plate 23 may include a planar cantilevered portion 70 that extends away from the intermediate portion 20 such that the cantilevered portion 70 is parallel to or is substantially parallel to the bottom surface 16 of the support platform 12.

Figure 7:
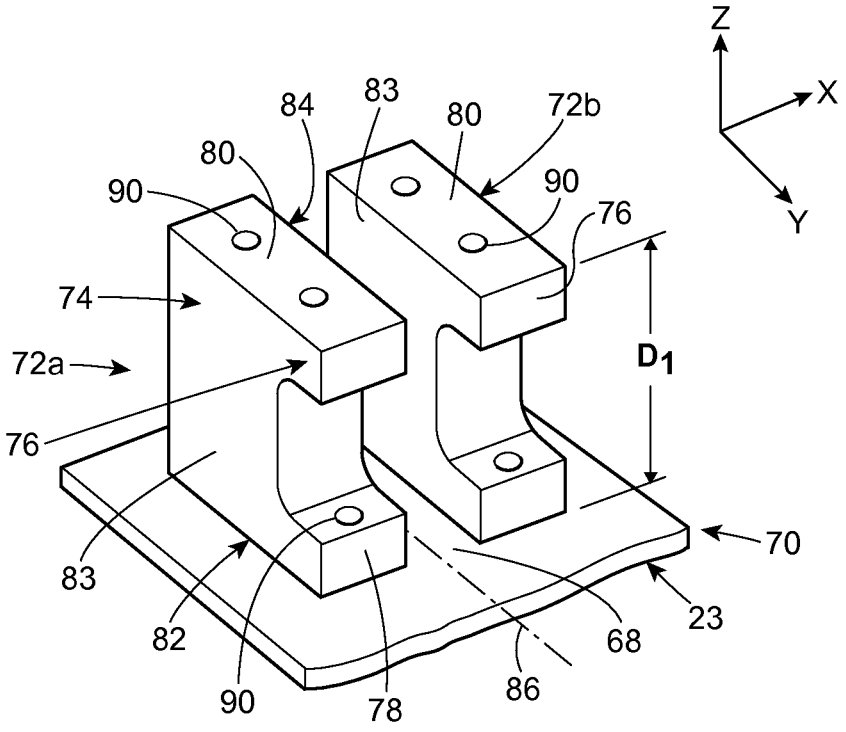
FIG. 7 is a perspective view of an embodiment of first and second stands disposed on a portion of an anti-cavitation plate with the support platform removed for clarity.

Referring now to FIGS. 1A, 1B, 2A, 2B, and 7, the mounting assembly 18 may include one or more stands 72 (individually labeled 72*a* and 72*b*) that may be disposed on a top surface 68 of the cantilevered portion 70 of the anti-cavitation plate 23. For example, as illustrated in FIG. 7, the mounting assembly 18 may include a first stand 72*a* and a second stand 72*b*. Each of the stands 72*a* and 72*b* may have any suitable cross-sectional shape, such as that of an elongated oval or a rectangle. As an additional example, each of the stands 72*a* and 72*b* may have a body 74 that extends in a vertical (i.e., along or parallel to the Z axis of the reference coordinate system provided in FIG. 7) or substantially vertical direction, as illustrated in FIG. 7. A top extension 76 may extend horizontally (i.e., along an axis normal to a vertical axis, such as along the Y axis of the reference coordinate system provided in FIG. 7) from a top portion of the body 74 and a bottom extension 78 may extend horizontally from a bottom portion of the body 74. The body 74 and the top extension 76 may cooperate to form a planar top surface 80, and the body 74 and the bottom extension 78 may cooperate to form a planar bottom surface 82 (also illustrated in FIG. 2A). The planar top surface 80 may be parallel to and vertically offset from the bottom surface 82 by a distance $D_1$, which may be approximately 6 inches, for example. Each of the first and second stands 72*a* and 72*b* may be defined by a first side wall 83 and a second side wall 84 that may extend from the top surface 80 to the bottom surface 82, and each of the side walls 83 and 84 may extend along a vertical plane that is parallel to the central axis 34 of the top surface 14 of the support platform 12 when viewed along a vertical axis.

Each of the stands 72*a*, 72*b* may have identical dimensions, or may have dimensions that may be unique to a particular stand 72*a*, 72*b* due to non-symmetrical features of the anti-cavitation plate 23 or the drive assembly housing 22, for example. Each stand 72*a*, 72*b* may be symmetrically disposed about a horizontal axis 86 passing longitudinally through the top surface 68 of the anti-cavitation plate 23, and the horizontal axis 86 may be parallel to or aligned with the central axis 34 of the support platform 12 when viewed along a vertical axis. More particularly, the second side wall 84 of the first stand 72*a* may be disposed a first horizontal distance from the horizontal axis 86 when viewed along a vertical axis, and the first side wall 83 of the second stand 72*b* may be disposed a second horizontal distance from the horizontal axis 86 when viewed along a vertical axis. If desired, the first horizontal distance may be equal to the second horizontal distance. However, the first horizontal distance and the second horizontal distance may each be any suitable value, and may not be equal.

Instead of the first and second stands 72*a* and 72*b* each being a single, unitary component, any or both of the first and second stands 72*a*, 72*b* may comprise two or more components, such as an assembly of vertically-stacked spacer blocks (not shown). Each spacer block may have an identical or generally horizontal cross-sectional shape, and the assembly of spacer blocks may cooperate to vertically offset a top surface 80 and a bottom surface 82 (of each of the first and second stands 72*a*, 72*b*) by a suitable distance $D_1$.

If the existing top surface 68 of the anti-cavitation plate 23 does not provide a suitable surface to support the first and second stands 72*a*, 72*b*, a mounting plate (not shown) may be secured to the anti-cavitation plate 23 to provide a planar support surface for the first and second stands 72*a*, 72*b*. For example, a bottom surface of the mounting plate may be shaped to engage all or a portion of the top surface 68 of the anti-cavitation plate 23, and the top surface of the mounting plate may be planar and may be dimensioned to support the entire bottom surface 82 of each of the first and second stands 72*a*, 72*b*. Such a mounting plate may be secured to the anti-cavitation plate 23 by any means known in the art, such as by mechanical fasteners or by welding, for example.

As illustrated in FIGS. 2A, 2B, and 7, one or more bores 90 may be disposed in the top surface 80 and the bottom surface 82 of each of the first and second stands 72*a*, 72*b*. In addition, a plurality of apertures 92 may extend through the cantilevered portion 70 of the anti-cavitation plate 23. Each of the plurality of apertures 92 (illustrated in FIGS. 2A and 2B) may be positioned on the cantilevered portion 70 to correspond to a bore 90 formed in the bottom surface 82 of the first and second stands 72*a*, 72*b* such that each of the apertures 92 may be coaxially aligned with a corresponding bore 90. The plurality of apertures 92 may have to be drilled through the anti-cavitation plate 23 as a secondary operation.

Referring to FIGS. 3 and 4, a plurality of fixture apertures 94 may be disposed in and extend through the top surface 14 to the bottom surface 16 of the support platform 12. Each of the plurality of fixture apertures 94 may be positioned on the support platform 12 to correspond to a bore 90 formed in the top surface 80 of the first and second stands 72*a*, 72*b* such that each of the plurality of fixture apertures 94 may be coaxially aligned with a corresponding bore 90.

To secure the support platform 12 to the mounting assembly 18 and the anti-cavitation plate 23, a bolt 96 is placed into each of the fixture apertures 94 (illustrated in FIGS. 3 and 4) of the support platform 12 such that the bolt 96 is received into a corresponding bore 90 formed in the top surface 80 of each of the first and second stands 72*a*, 72*b*, as illustrated in FIGS. 2A, 2B, and 7. A threaded portion of one of the bolts 96 may protrude from a bore 90 disposed through the top extension 76 of each of the first and second stands 72*a*, 72*b*, and a nut 98 may be coupled to the threaded portion of the bolt 96 to secure the support platform 12 to each of the first and second stands 72*a*, 72*b*. Bolts 96 that are each received into a corresponding bore 90 extending through the body 74 of each of the first and second stands 72*a*, 72*b* may have a threaded portion extending through a corresponding aperture 92 of the cantilevered portion 70 of the anti-cavitation plate 23. A nut 98 may be coupled to the threaded portion of each bolt 96 to secure the support platform 12 to each of the first and second stands 72*a*, 72*b* and to the anti-cavitation plate 23. A pair of additional bolts 96 may be inserted into apertures 92 of the cantilevered portion 70 of the anti-cavitation plate 23 such that a threaded portion of each of the pair of bolts 96 extends through apertures 90 formed through the bottom extension 78 of each of the first and second stands 72*a*, 72*b*. A nut 98 may be coupled to the threaded portion of each bolt 96 to secure each of the first and second stands 72*a*, 72*b* to the anti-cavitation plate 23. Alternatively, the mounting assembly 18 may be coupled to the support platform 12 and/or the anti-cavitation plate 23 (or to any suitable portion of the drive assembly housing 22 of the vessel 26) by any means known in the art, such as by mechanical coupling, welding, or adhesives, for example.

As illustrated in FIGS. 1A, 1B, 2A, and 2B, the mounting assembly 18 may be mounted to the anti-cavitation plate 23 which may itself be secured to a portion of an outboard motor assembly or an inboard/outboard drive assembly. An outboard motor assembly is a self-contained marine propulsion unit that is typically secured to the outside of the transom 27 of a watercraft or vessel 26. The outboard motor assembly includes an engine (not shown) disposed above the waterline 24, and the engine rotates an elongated shaft that in turn transmits power to a 90-degree angle gearbox. The power provided to the gearbox is output to a propeller 99, which is disposed at or adjacent to a distal end of the outboard motor assembly. The propeller 99 is disposed below the waterline 24, and the rotation of the propeller 99 provides propulsion to the vessel 26. The shaft is protected by a drive assembly housing 22, and an anti-cavitation plate 23 may be directly or indirectly coupled to an intermediate portion 20 of the drive assembly housing 22. So positioned, the anti-cavitation plate 23 reduces the cavitation caused by the propeller 99 by reducing the amount of air that is available to be sucked into the water by the propeller 99.

In an inboard/outboard drive (illustrated in FIGS. 1A, 1B, 2A, and 2B), the engine (not shown) is typically located inboard and adjacent to the transom 27 of the vessel 26, and the engine provides power to the drive unit located outside the hull. This drive unit (also called an outdrive) resembles the bottom half of an outboard motor, and the drive unit includes a drive assembly housing 22 that surrounds and protects the components that transmit power from the engine to a propeller 99. The drive assembly housing 22 may include an upper unit that contains a drive shaft that connects through the transom 27 to the engine and transmits power to a 90-degree-angle gearbox. The drive assembly housing 22 may also include a lower unit that bolts onto the bottom of the upper unit and contains a vertical drive shaft that transmits power from the upper unit gearbox down to another 90-degree-angle gearbox in the lower unit, which connects to a propeller shaft. Thus, the drive unit carries power from the inboard engine, typically mounted above the waterline 24, outboard through the transom 27 and downward to the propeller 99 below the waterline 24. An anti-cavitation plate 23 may be directly or indirectly coupled to an intermediate portion 20 of the drive assembly housing 22. The intermediate portion 20 of the drive assembly housing 22 may be at or adjacent to the junction between the upper unit and the lower unit of the drive unit, for example.

With the platform assembly 10 secured to an intermediate portion 20 of a drive assembly housing 22 as described above, the top surface 14 of the support platform 12 is disposed below the waterline 24 when the vessel 26 is stationary or is traveling in a forward direction at or below a critical rate of speed, as illustrated in FIGS. 1A and 2A. However, when the vessel 26 travels in a forward direction at a rate of speed that is above a critical rate of speed, as illustrated in FIGS. 1B and 2B, the bottom surface 16 is disposed above the waterline 24 due to the planing of the vessel 26 and/or the creation of a depression in the surface of the water 24 downstream of the transom 27.

One having ordinary skill in the art would recognize that the critical rate of speed for a particular vessel may vary based on several factors, such as, for example, hull geometry. Accordingly, the critical rate of speed may be any rate of speed that results in a depression in the surface of the water downstream of the transom 27 that results in the bottom surface 16 of the support platform 12 to be contained within the depression such that the bottom surface 16 of the support platform 12 is disposed above the surface of the water 24. Moreover, the critical rate of speed may be any rate of speed that results in an elevation of a hull of a vessel 26 hull relative to the waterline 24 (i.e., planing) such that the bottom surface 16 of the support platform 12 is maintained in a position above the surface of the water 24. One having ordinary skill in the art would recognize that the bottom surface 16 of the support platform 12 may be maintained above the surface of the water 24 at or above the critical rate of speed by either or a combination of planing or the formation of a depression in the surface of the water 24 downstream of the transom 27.

The depression in the surface of the water 24 downstream of the transom 27 may converge towards the longitudinal axis of the vessel 26 as the depression extends away from the transom 27. Accordingly, the converging edges of the support platform 12 (defined by the first and second oblique edge segments 46, 48 of the top and bottom peripheral edges 28, 30) conforms the support platform 12 to the shape of the depression, thereby allowing the entire support platform 12 to remain in the depression (i.e., above the surface of the water that defines the depression) as the depression converges towards the longitudinal axis of the vessel 26. The oblique edge segments 46, 48 may form any suitable angle relative to the central axis 34 of the top surface 14 that results in a support platform 12 shape that corresponds to the shape of the depression such that the entire bottom surface 16 of the support platform 12 is disposed within the depression when the rate of speed of the vessel 26 is above the critical rate of speed. One having ordinary skill in the art would recognize that the angle between the oblique edge segments 46, 48 and the central axis 34 may depend on several factors, such as the shape and size of the transom 27 (and the entire hull) that generates the depression, for example.

The first and second stands 72*a*, 72*b* may be dimensioned to provide any suitable vertical separation between the top surface 68 of the cantilevered portion 70 of the anti-cavitation plate 23 and the bottom surface 16 of the support platform 12 to allow the bottom surface 16 to be above the surface of the water 24 when the vessel 26 is traveling at or above the critical rate of speed and to allow the top surface 14 of the support platform 12 to be below the surface of the water 24 at or below the critical rate of speed. For example, the first and second stands 72*a*, 72*b* may have a vertical dimension (i.e., the distance $D_1$) such that the vertical distance between the top surface 14 of the support platform 12 is approximately 15 inches below the waterline 24 when the vessel 26 is stationary. Furthermore, as best illustrated in FIGS. 2A and 2B, the support platform 12 is cantilevered out over the anti-cavitation plate 23 and thus the outward wall segment 44 is disposed significantly out beyond the propeller 99 when viewed along a vertical axis. In fact, the sizing of the support platform 12 (and thus the distance that the support platform 12 extends out beyond the propeller 99) is dependent on the vessel characteristics including the shape of the depression created behind the vessel when the vessel is moving above the critical rate of speed.

While various embodiments have been described above, this disclosure is not intended to be limited thereto. Variations can be made to the disclosed embodiments that are still within the scope of the appended claims.

What is claimed is:

1. A platform assembly adapted to be mounted to a drive assembly housing of a watercraft, the platform assembly comprising:

a support platform having a planar top surface and a bottom surface, the support platform adapted to provide a stable support for a swimmer; and a mounting assembly coupled to the support platform, the mounting assembly adapted to be secured to a portion of the drive assembly housing such that the top surface of the support platform is disposed below the surface of the water when the watercraft is traveling in a forward direction at or below a critical rate of speed, and such that the bottom surface of the support platform is disposed above the surface of the water when the watercraft is traveling in a forward direction above the critical rate of speed;

wherein the mounting assembly is adapted to be secured to an intermediate portion of the drive assembly housing;

wherein an anti-cavitation plate extends from the intermediate portion of the drive assembly housing, and the mounting assembly is adapted to be secured to the anti-cavitation plate;

wherein the mounting assembly includes one or more stands, and the one or more stands are adapted to be disposed between the bottom surface of the support platform and a top surface of a cantilevered portion of the anti-cavitation plate;

wherein the mounting assembly includes a first stand and a second stand, and each of the first stand and the second stand includes a vertical body, a top extension extending horizontally from a top portion of the body, and a bottom extension extending horizontally from a bottom portion of the body;

wherein a bore extends through the top extension of each of the first stand and the second stand such that each bore is coaxially aligned with a corresponding fixture aperture formed in the support platform, and wherein the each bore and corresponding fixture aperture is adapted to receive a bolt that secures the support platform to each of the first stand and the second stand.

2. The platform assembly of claim 1, wherein the first stand and the second stand are symmetrically disposed about a horizontal axis passing longitudinally through the top surface of the anti-cavitation plate.

3. The platform assembly of claim 1, wherein a bore extends through the bottom extension of each of the first stand and the second stand such that each bore is coaxially aligned with a corresponding aperture extending through the cantilevered portion of the anti-cavitation plate, and wherein the each bore and corresponding aperture is adapted to receive a bolt that secures the anti-cavitation plate to each of the first stand and the second stand.

4. The platform assembly of claim 1, wherein the support platform has a longitudinally-disposed central axis, and the support platform is partially defined by a pair of side oblique wall segments that each converges towards the central axis as the oblique wall segments extend away from the watercraft.

5. The platform assembly of claim 4, wherein the support platform is adapted to be cantilevered over the anti-cavitation plate such that an outward wall segment is disposed beyond a propeller when viewed along a vertical axis, wherein the propeller is disposed at or adjacent to a distal end of the drive assembly housing.

6. The platform assembly of claim 1, wherein the support platform includes at least one aperture extending between the top surface and the bottom surface, wherein each of the at least one apertures is an elongated slot that is longitudinally aligned with and adjacent to an edge of the support platform.

7. The platform assembly of claim 1, wherein the top surface of the support platform has a surface treatment to increase the frictional engagement between a swimmer's foot or hand and the support platform.

* * * * *